US005833192A

United States Patent [19]

Buhrman

[11] Patent Number: 5,833,192

[45] Date of Patent: Nov. 10, 1998

[54] ADJUSTABLE MOUNT FOR SHOWER HEAD

[76] Inventor: Scott E. Buhrman, #1 Woodglen Est., St. Charles, Mo. 63304

[21] Appl. No.: 723,904

[22] Filed: Oct. 1, 1996

[51] Int. Cl.[6] ..... A47F 1/10

[52] U.S. Cl. ..... 248/295.11; 248/316.7

[58] Field of Search ..... 248/295.11, 316.7, 248/297.21; 4/615, 605, 597

[56] References Cited

U.S. PATENT DOCUMENTS

| | | | |
|---|---|---|---|
| 3,375,532 | 4/1968 | Gellman . | |
| 3,806,963 | 4/1974 | Flynn . | |
| 3,933,329 | 1/1976 | Granger . | |
| 4,174,822 | 11/1979 | Larsson . | |
| 4,224,700 | 9/1980 | Bloys . | |
| 4,274,400 | 6/1981 | Baus . | |
| 4,360,159 | 11/1982 | Haynes | 4/605 |
| 4,561,136 | 12/1985 | Baer . | |
| 5,035,010 | 7/1991 | Sakamoto et al. . | |
| 5,277,391 | 1/1994 | Haug et al. . | |

OTHER PUBLICATIONS

Photocopy of Hi–Lo Shower Set package photograph.

*Primary Examiner*—Leslie A. Braun
*Assistant Examiner*—Willie Berry, Jr.
*Attorney, Agent, or Firm*—Senniger, Powers, Leavitt & Roedel

[57] ABSTRACT

A mount for use in combination with a shower surround having a shower pipe extending outward from a wall of the surround for connection to a flexible hose extending to a hand-held shower head for supplying the shower head with water from the pipe. The mount is for holding the hand-held shower head at a level convenient for use by a person taking a shower. The mount comprises an elongate support having a clamp at a first end constituting its upper end for releasably clamping the support to the shower pipe. The support extends generally downward from the shower pipe and has a foot at a second end opposite the first end for engagement with the wall to steady the support while remaining free of connection to the wall. The clamp and foot hold the support in a generally vertical position spaced from the wall. The mount further comprises a holder for holding the shower head in a position wherein water dispensed from the shower head is directed toward the person taking the shower. The holder is mounted on the support for selectable adjustment to different positions relative to the support to thereby permit adjustment of the mount to hold the shower head at the level convenient for use by the person taking the shower.

12 Claims, 4 Drawing Sheets

ADJUSTABLE MOUNT FOR SHOWER HEAD

BACKGROUND OF THE INVENTION

This invention relates generally to a mount for mounting a hand-held shower head on a wall of a shower surround. In particular, the invention relates to a mount which may be removed from the shower without damaging the wall.

Conventional shower head mounts comprise an elongate support which rigidly attaches to a shower surround wall and a holder connected to the support for holding the shower head. In the past, the support was usually attached to the wall with semi-permanent means such as with adhesives and/or fasteners which penetrated the surface of the wall. For example, screw fasteners and permanent adhesives were customarily used to attach the support to the wall.

Frequently, adjustable mounts are used in combination with hand-held shower heads to permit the level of the shower head to be lowered from a typical wall-mounted shower head level for use by children and the infirm. The adjustability of the mount permits the shower head to be changed as the children grow to accommodate their increasing height, and permits temporary repositioning of the shower head when persons of differing heights use the shower. Once the children are grown, it is often desirable to remove the mount from the shower surround wall to restore the shower to its original condition and appearance. In the past, removal frequently damaged the surround because the supports were attached to the wall with semi-permanent means as previously described.

Shower surround walls are typically covered with materials which are expensive. Further, repairing the walls can be difficult and time consuming. Yet, if the walls are not repaired, significant damage can occur to the structures within and behind the walls. As a result, damage to shower surround walls is undesirable and should be avoided.

SUMMARY OF THE INVENTION

Among the several objects and features of the present invention may be noted the provision of a mount for holding a shower head at a level convenient for use by a person taking a shower; provision of a mount which is adapted to include a horizontally extending section sized for clearing an obstruction projecting from the wall; provision of a mount configured to permit hand-held use of the shower head; provision of a mount which may easily and quickly be installed with minimal tools and effort; and provision of a mount which may be removed without damaging the wall to which it was attached.

Briefly, apparatus of this invention is a mount for use in combination with a shower surround having a shower pipe extending outward from a wall of the surround for connection to a flexible hose extending to a hand-held shower head for supplying the shower head with water from the pipe. The mount is for holding the hand-held shower head at a level convenient for use by a person taking a shower. The mount comprises an elongate support having a clamp at a first end constituting its upper end for releasably clamping the support to the shower pipe. The support extends generally downward from the shower pipe and has a foot at a second end opposite the first end for engagement with the wall to steady the support while remaining free of connection to the wall. The clamp and foot hold the support in a generally vertical position spaced from the wall. The mount further comprises a holder for holding the shower head in a position wherein water dispensed from the shower head is directed toward the person taking the shower. The holder is mounted on the support for selectable adjustment to different positions relative to the support to thereby permit adjustment of the mount to hold the shower head at the level convenient for use by the person taking the shower.

In another aspect of the invention, the mount comprises an elongate support adapted for attachment to the wall and a holder for holding the shower head in a position wherein water dispensed from the shower head is directed toward the person taking the shower. The holder is mounted on the support for selectable adjustment to different positions relative to the support to thereby permit adjustment of the mount to hold the shower head at the level convenient for use by the person taking the shower. The mount also comprises alignment means for maintaining the holder perpendicular to the wall regardless of the holder position along the support.

Other object and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
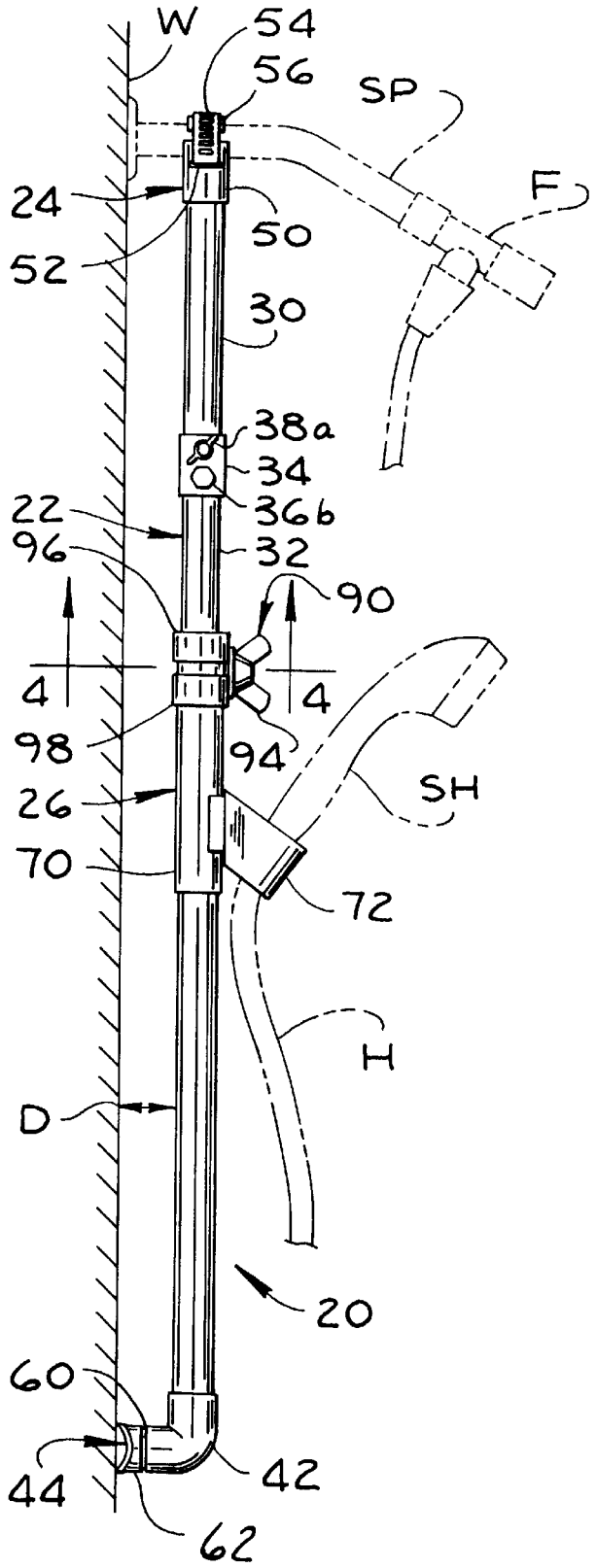
FIG. 1 is a side elevation of a mount of the present invention for holding a hand-held shower head at a level convenient for use by a person taking a shower.

Referring now to the drawings and in particular to FIG. 1, the mount of the preferred embodiment is indicated generally at 20. The mount 20 comprises a tubular support generally designated by 22 having a clamp generally designated by 24 for releasably clamping the support to a shower pipe SP mounted on a wall W. The mount 20 further comprises a bracket generally designated by 26 which is connected to the support 22 for holding a shower head SH in a fixed position relative to the shower pipe SP.

The support 22 of the preferred embodiment is fashioned from two tubes 30, 32 fastened together with a coupling 34. Holes (not shown) extend through the tubes 30, 32 and coupling 34 to accept bolts 36*a*, 36*b* for releasably fastening the tubes and coupling together. Wing nuts 38*a*, 38*b* are threaded onto the bolts 36*a*, 36*b* to retain the bolts in their respective holes and to permit the tubes 30, 32 and coupling 34 to be disassembled without using tools. Although other tubing lengths are envisioned as being within the scope of the present invention, in the preferred embodiment the upper tube 30 is approximately seven inches long and the lower tube 32 is approximately 29 inches long. It is also envisioned that a single piece of tubing may be used in place of the tubes 30, 32, coupling 34, bolts 36*a*, 36*b*, and wing nuts 38*a*, 38*b* without departing from the scope of the present invention. Further, other connecting means may be used to fasten the tubes 30, 32 together without departing from the scope of the present invention. For instance, a threaded coupling (not shown) and tubes having threaded ends (not shown) may be used to releasably fasten the tubes to each other. Adhesives may also be used to bond the components together.

Figure 2:
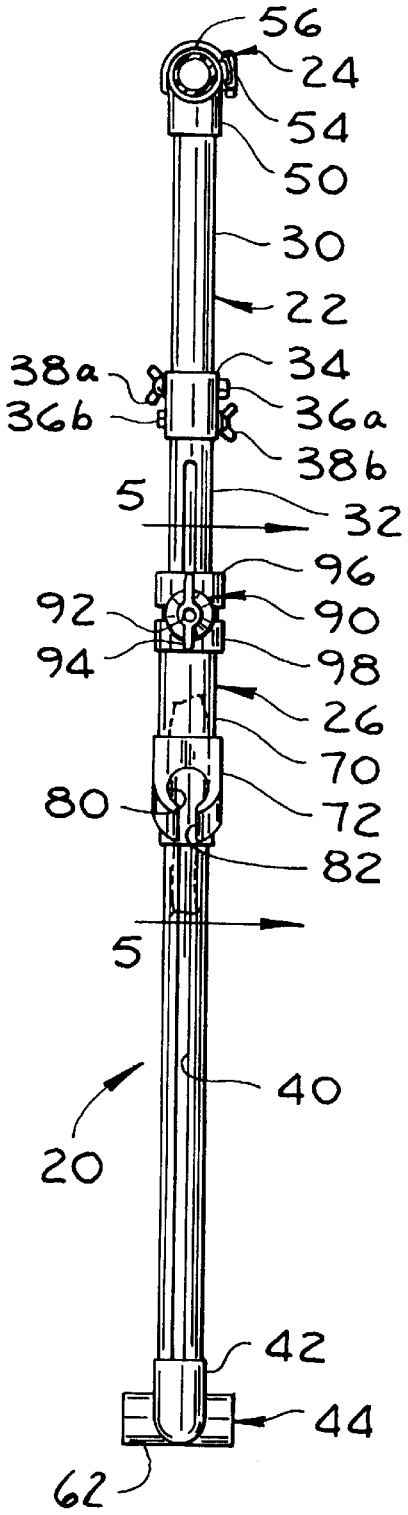
FIG. 2 is a front elevation of the mount showing a holder for holding the shower head located in a raised position.

As shown in FIG. 2, an elongate slot 40 is formed lengthwise along the lower tube 32 for aligning the bracket 26 with the wall W as will be explained in greater detail below. An elbow 42 is bonded to the lower end of the lower tube 32 for receiving a foot generally designated by 44. The foot 44 rests against the wall W to brace the lower end of the support 22 against the wall W to discourage the support from moving. For manufacturing convenience, the slot 40 of the preferred embodiment extends to the lower end of the lower tube 32. Once the bracket 26 is installed on the support 22, the elbow 42 is bonded to the lower tube 32 with PVC cement to close the lower end of the slot and to capture the bracket on the support.

Although other materials are envisioned as being within the scope of the present invention, the tubes and fittings (i.e., the couplings, elbows and tees) forming the support 22 of the preferred embodiment are made of polyvinyl chloride (PVC). This material is advantageous because it is resistant to attack by water and other chemicals generally found in showers and it is soft enough that it will not mar typical shower surrounds.

The tubes and fittings used to form the support of the preferred embodiment are ¾ inch in diameter; however, tubes and fittings having other diameters are also envisioned as being within the scope of the present invention.

The clamp 24 of the preferred embodiment is made by cutting a tee fitting to form a short, rounded crotch member 50. Prior to being modified, the conventional tee fitting has a main portion which has an opening at each end and a branch portion which extends outward at 90° from the main portion, halfway between the main portion ends. The crotch member 50 is formed by cutting the main portion lengthwise to remove about half of the main portion opposite the branch portion. The ends of the main portion are cropped to shorten the overall length of the clamp 24 so it may be clamped to shower pipes SP having short horizontal sections. Rectangular openings 52 (only one is visible in FIG. 1) are formed in the tee, near the junction of the main and branch portions on opposite sides of the crotch member 50. A hose clamp 54 is threaded through the openings 52 so it can be wrapped around the shower pipe SP with the crotch member 50 positioned against the pipe as shown in FIG. 2 to clamp the mount 20 to the pipe. A short, semi-circular piece of tubing or fitting 56 may be positioned between the hose clamp 54 and shower pipe SP, opposite the crotch 50, to prevent the hose clamp from marring the shower pipe. Thus constructed, the clamp 24 of the preferred embodiment is adapted to hold the upper end of the support 22 so the support extends downward and substantially perpendicular to the shower pipe SP at a generally constant distance D from the wall W.

As further shown in FIG. 1, the foot 44 which supports the lower end of the support 22 is made by bonding a short length of tubing 60 to a modified tee 62. The tee 62 is modified by cutting the main portion lengthwise to remove about half of the main portion opposite the branch portion. The branch portion may be shortened if desired as shown in FIG. 1 to reduce the distance D between the support 22 and the wall. When the mount 20 is installed, the foot 44 is free of connection to the wall W. The foot 44 simply rests against the wall to brace the lower end of the support 22, thereby discouraging the support from moving substantially.

Figure 5:
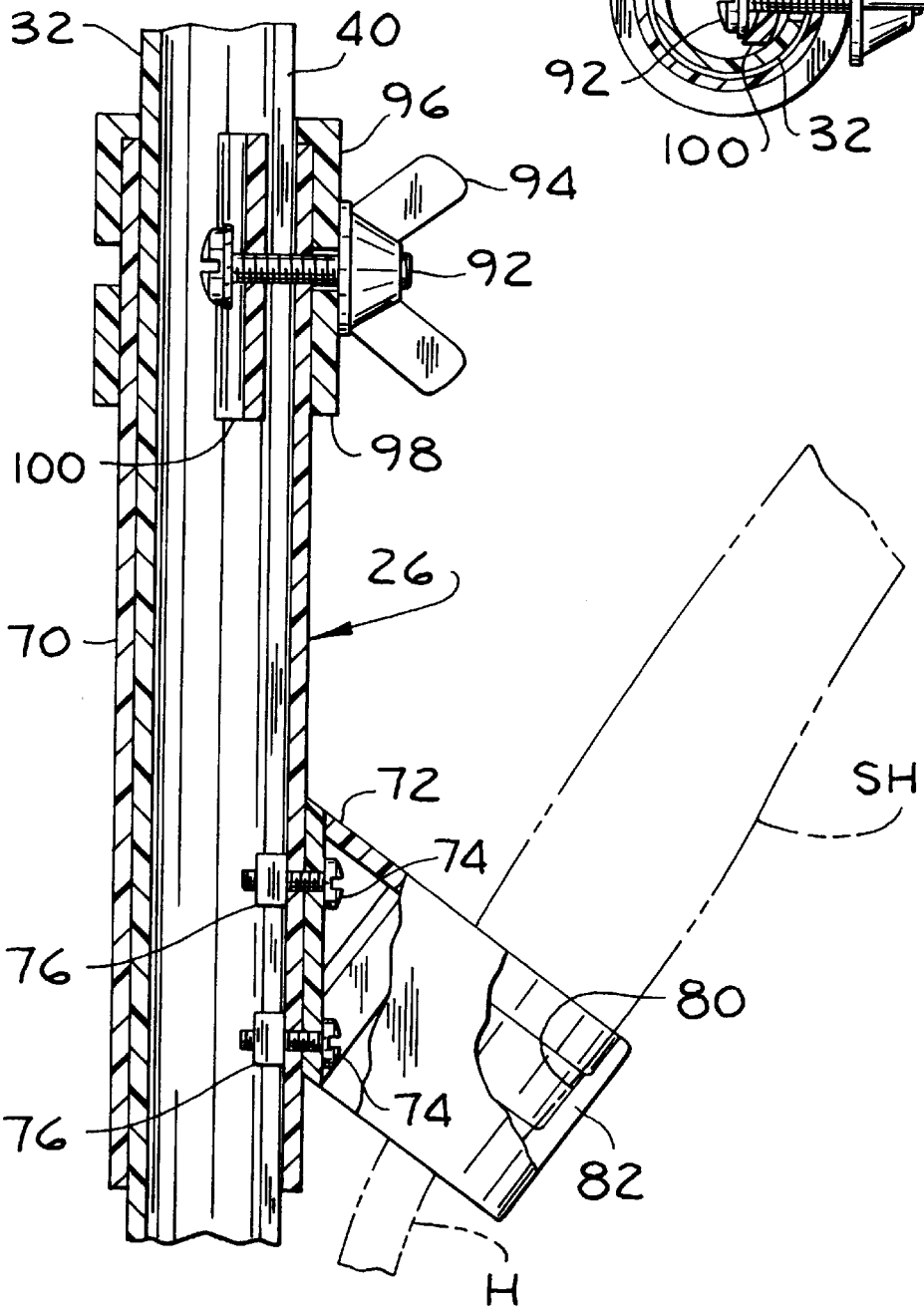
FIG. 5 is a cross section of the mount taken in the plane of line 5—5 of FIG. 2.

As shown in FIG. 5, the bracket 26 generally comprises a length of pipe 70 and a shower head holder 72 which are joined by screws 74 threaded into shaped nuts 76. The nuts 76 are shaped for receipt in the slot 40 provided in the lower support tube 32 to ensure the shower head holder 72 remains aligned with the slot and substantially perpendicular to the wall W regardless of the position of bracket 26 along the slot. Although the pipe 70 of the preferred embodiment is about six inches long, it is envisioned that other lengths may be used without departing from the scope of the present invention. The pipe 70 of the preferred embodiment is one inch diameter PVC pipe so the lower support tube 32 can slide through the bracket 26 as it is moved up and down along the support 22. It is envisioned that the bracket pipe 70 may be made of a different materials and may have different diameters without departing from the scope of the present invention.

The bracket 26 includes a stepped opening 80 for receiving a conventional hand-held shower head SH. The stepped opening 80 accommodates different diameter shower heads SH so the mount 20 can be used with any of several commonly available shower heads. The opening 80 is obliquely angled with respect to the support 22 to direct the shower head SH at a convenient angle for bathers. A slot 82 is provided on the side of the holder 72 to permit the hose H to pass through the bracket 26 when installing and removing the shower head SH from the bracket. Thus, the bracket 26 is configured for selectively removing the shower head SH from the bracket for hand-held use.

Figure 3:
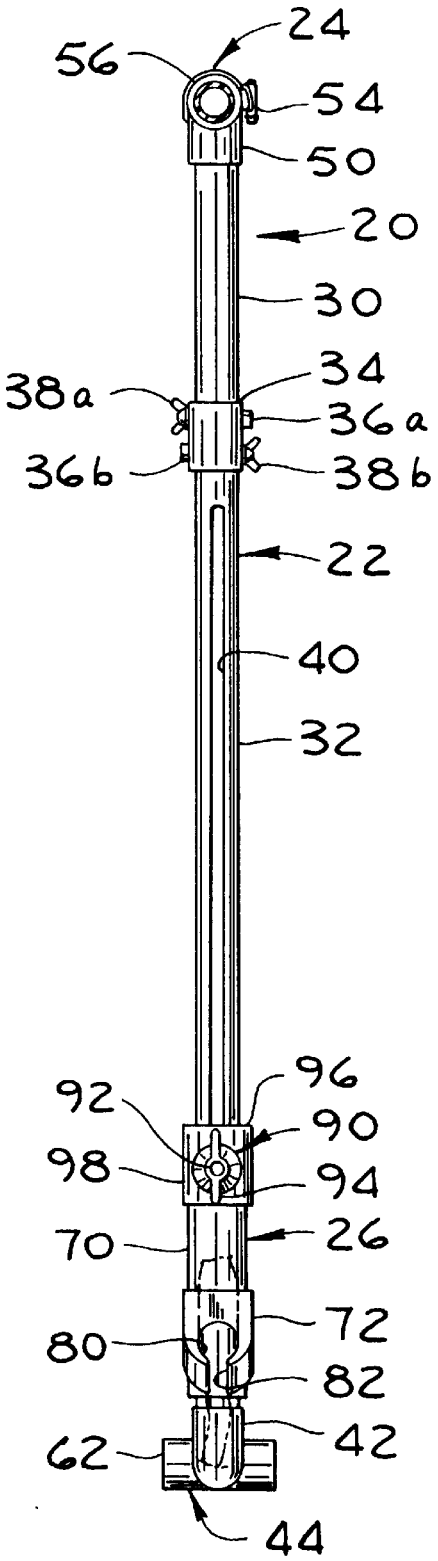
FIG. 3 is a front elevation of the mount showing the holder located in a lowered position.
Figure 4:
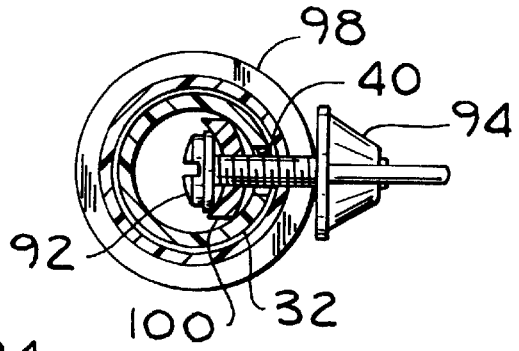
FIG. 4 is a cross section of the mount taken in the plane of line 4—4 of FIG. 1.

As shown in FIGS. 4 and 5, a clamp generally designated 90 is formed at the upper end of the bracket 26 by a screw and nut 92, 94, respectively, to hold the bracket at any desired location along the slot 40. The bracket 26 is reinforced adjacent the clamp by two sections of a coupling 96, 98 adhesively bonded to the exterior of the pipe 70. As will be apparent to those of ordinary skill in the art, this reinforcement is also provided for manufacturing convenience. The upper coupling section 96 is used to close off an end of a slot (not shown) into which the screw 92 is received when assembling the bracket 26. Further, the two coupling sections 96, 98 support both the upper and lower edges of the nut 94 to prevent bending stresses from developing in the screw 92. A small section of tubing 100 is positioned between the head of the screw 92 and the lower support tube 32 to distribute the clamping force over the interior of the support 22. As illustrated in FIG. 4, the screw forms a projection which slides within the support slot 40 to further align the bracket 26. Together the screw 92 and shaped nuts 76 constitute alignment means for maintaining the bracket 26 perpendicular to the wall W regardless of the bracket position along the support 22. The bracket 26 (and thus the shower head SH) may be raised or lowered by loosening the nut 94 and moving the bracket up or down over the support 22. When the desired level is reached, the nut 94 may be tightened to clamp the bracket 26 in position on the support 22. Thus, the bracket 26 may raised to a position as shown in FIG. 2 or lowered to a position as shown in FIG. 3.

Figure 6:
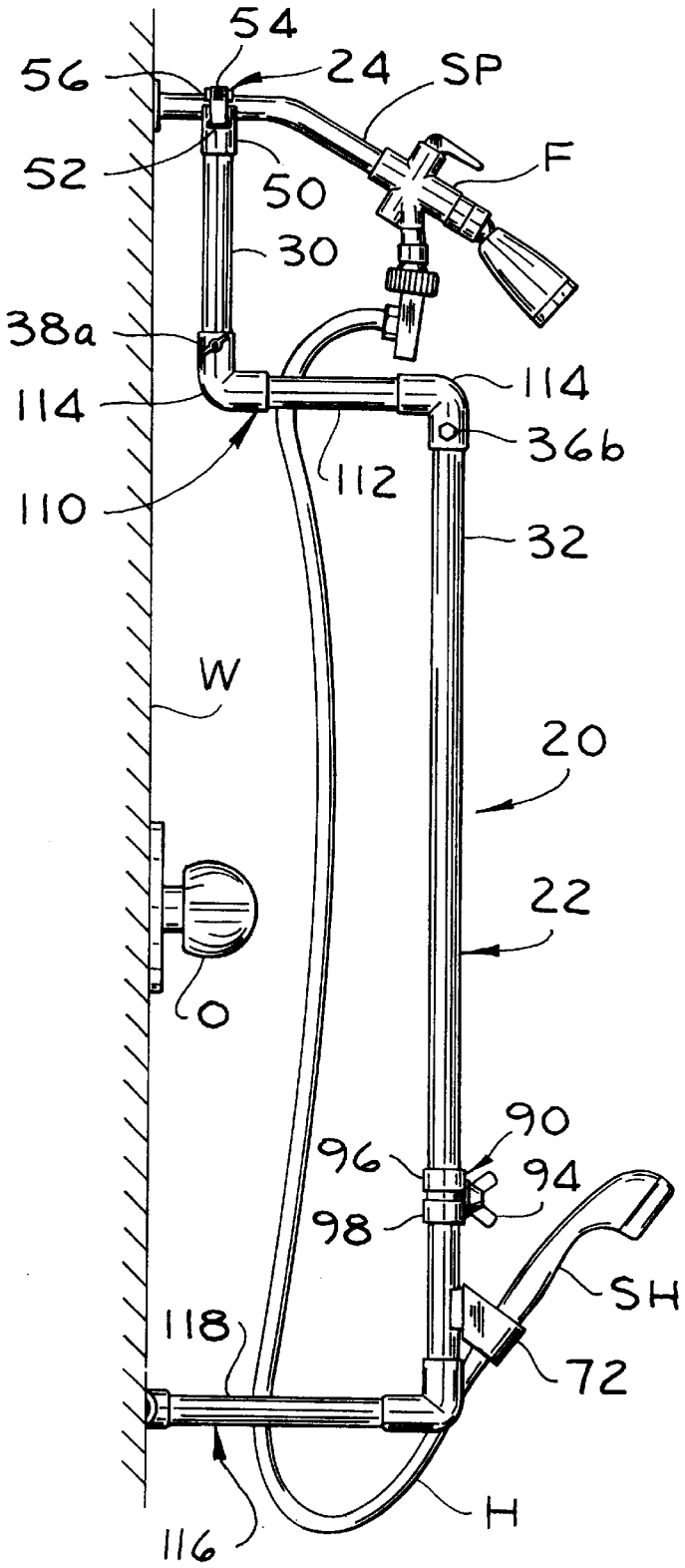
FIG. 6 is a side elevation of the mount showing a horizontal extending section sized for clearing an obstruction projecting from the wall.

FIG. 6 shows an alternate configuration of the preferred embodiment of the mount 20 of the present invention which includes a horizontally extending section, generally designated by 110, sized for positioning the support 22 to clear an obstruction O projecting from the wall W. The obstruction O may be a soap dish, a control valve, a towel rack or any other obstruction which projects from the wall. The horizontally extending section 110 is formed from a tube 112 having an elbow 114 bonded to each end as shown. Holes (not shown) are provided in the elbows 114 for receiving the bolts **36*a*, 36*b* as previously described with respect to the coupling 34 joining the support tubes 30, 32. Although other lengths are also envisioned as being within the scope of the present invention, the tube 112 of the preferred embodiment is approximately three inches long. To compensate for the increased distance D between the lower support section 32 and the wall W caused by the horizontally extending section 110, the previously described foot 44 is replaced with a foot generally designated by 116 having a longer tube (e.g., about 3½ inches) 118 so the lower end of the support can rest against the wall. Thus constructed, the support can be positioned so it hangs vertically below the shower pipe SP without interfering with obstructions O such as the center-mounted control valve shown in FIG. 6**.

Although the preferred embodiment of the mount is presently fabricated from commonly available off-the-shelf hardware as described above, it is envisioned that custom parts could be specially manufactured to produce the mount without departing from the scope of the present invention.

The mount 20 is used in combination with a conventional hand-held shower head SH as shown in FIGS. 1 and 6. The shower head SH is installed in the customary manner using a fitting F connected to the shower pipe SP, and the mount 20 is installed on the shower pipe SP by clamping the support clamp 24 to the shower pipe so the foot 44 or 116 rests against the wall W. With the support 22 in position, the bracket clamp 90 may be loosened to position the bracket 26 at any desired location along the slot 40 before tightening the clamp 90 to hold the bracket 26 in position. When the water is turned on so it is directed through the shower head SH, the mount 20 holds the shower head in a fixed position to direct the spray toward the bather.

When the mount 20 is no longer needed and its removal is desired, the clamp is simply unclamped and the mount is removed. Because adhesives are not used to attach the mount to the wall, no residue remains on the wall of the shower surround. Further, because the fasteners do not penetrate the wall, the wall is not damaged or marred.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mount for use in combination with a shower surround having a shower pipe extending outward from a wall of the surround for connection to a flexible hose extending to a hand-held shower head for supplying the shower head with water from the pipe, the mount for holding the hand-held shower head at a level convenient for use by a person taking a shower, the mount comprising:

an elongate support having a clamp at a first end constituting its upper end for releasably clamping the support to the shower pipe at a position spaced from the wall, the support adapted to extend generally downward from the shower pipe and having a foot at a second end opposite said first end for engagement with the wall to steady the support while remaining free of connection to the wall whereby the foot is adapted to merely rest against the wall, the clamp and foot holding the support in a generally vertical position spaced from the wall; and a holder for holding the shower head in a position wherein water dispensed from the shower head is directed toward the person taking the shower, the holder being mounted on the support for selectable adjustment to different positions relative to the support to thereby permit adjustment of the mount to hold the shower head at the level convenient for use by the person taking the shower.

2. A mount as set forth in claim 1 wherein the support includes at least one horizontally extending section sized for positioning the support to clear an obstruction projecting from the wall.

3. A mount as set forth in claim 1 wherein the holder is configured for selectively removing the shower head from the holder for hand-held use.

4. A mount as set forth in claim 1 wherein the clamp is adapted to hold the support substantially perpendicular to the shower pipe.

5. A mount for use in combination with a shower surround having a shower pipe extending outward from a wall of the surround for connection to a flexible hose extending to a hand-held shower head for supplying the shower head with water from the pipe, the mount for holding the hand-held shower head at a level convenient for use by a person taking a shower, the mount comprising:

an elongate support adapted for mounting on the wall;

a holder for holding the shower head in a position wherein water dispensed from the shower head is directed toward the person taking the shower, the holder being mounted on the support for selectable adjustment to different positions relative to the support to thereby permit adjustment of the mount to hold the shower head at the level convenient for use by the person taking the shower; and alignment means for maintaining the holder perpendicular to the wall regardless of the holder position along the support, wherein said alignment means includes a projection extending from one of the holder and the support and a slot formed in the other of the holder and support for receiving the projection.

6. A mount as set forth in claim 5 wherein the projection extends from the holder and the slot is formed in the support.

7. A mount as set forth in claim 6 wherein the projection is a screw fastener extending from the support.

8. A mount as set forth in claim 5 wherein the support includes a clamp at a first end of the support constituting its upper end for releasably clamping the support to the shower pipe.

9. A mount as set forth in claim 8 wherein the support includes a foot at a second end of the support opposite said first end for engagement with the wall to steady the support while remaining free of connection to the wall.

10. A mount as set forth in claim 9 wherein the clamp is adapted to hold the support substantially perpendicular to the shower pipe.

11. A mount as set forth in claim 5 wherein the support includes at least one horizontally extending section sized for positioning the support to clear an obstruction projecting from the wall.

12. A mount as set forth in claim 5 wherein the holder is configured for selectively removing the shower head from the holder for hand-held use.

* * * * *